US005203968A

United States Patent [19]

Henricson

[11] Patent Number: 5,203,968

[45] Date of Patent: Apr. 20, 1993

[54] APPARATUS FOR TREATING FIBER SUSPENSIONS HAVING ROTATABLE LIQUID PERMEABLE TREATMENT DUCTS

[75] Inventor: Kaj Henricson, Kotka, Finland

[73] Assignee: A. Ahlstrom Corporation, Noormarkku, Finland

[21] Appl. No.: 782,499

[22] Filed: Oct. 25, 1991

Related U.S. Application Data

[63] Continuation-in-part of Ser. No. 336,712, Apr. 12, 1989.

[30] Foreign Application Priority Data

Apr. 13, 1988 [FI] Finland ..... 881725

[51] Int. Cl.[5] ..... D21C 9/02; D21C 9/06

[52] U.S. Cl. ..... 162/380; 68/148; 68/152

[58] Field of Search ..... 162/52, 60, 380, 246, 162/232; 68/181 R, 158, 13 R, 43, 148, 152; 210/780, 198.1, 381

[56] References Cited

U.S. PATENT DOCUMENTS

| | | | |
|---|---|---|---|
| 3,259,538 | 7/1966 | Schnyder | 162/52 |
| 4,769,986 | 9/1988 | Kokkune et al. | 162/60 |
| 4,827,741 | 5/1989 | Luthi | 162/60 |

*Primary Examiner*—Steve Alvo

*Attorney, Agent, or Firm*—Cohen, Pontani, Lieberman, Pavane

[57] ABSTRACT

The present invention relates to the treating of fiber suspensions in the pulp and paper industry and particularly to a method and apparatus for washing fiber suspensions.

The method is characterized in that the fiber suspension is fed into the treatment apparatus, the desired process is carried out and the suspension is discharged from the apparatus in such a way that the fiber suspension is fed directly from the conduit to the treatment ducts mounted between the end plates of the rotational parts of the washer thus forming substantially extensions of the conduit. The fiber suspension is treated in the ducts and thereafter the treated suspension is discharged from the ducts by feeding yet untreated suspension to the apparatus.

The apparatus includes a plurality of axially elongated treatment ducts (9) arranged in the form of a ring around an axis of rotation. The ducts are radially limited by filter surfaces (10, 11) and in the direction of the end walls divided by partition walls (8). The ducts are rotatably arranged around shaft (12) inside casing (2). A feed conduit (4) for the pulp is arranged at one end of the apparatus and a discharge conduit (6) for the treated pulp at the opposite end thereof. The feed and discharge conduits are sequentially registrable with the same treatment duct.

24 Claims, 6 Drawing Sheets

APPARATUS FOR TREATING FIBER SUSPENSIONS HAVING ROTATABLE LIQUID PERMEABLE TREATMENT DUCTS

The present application is a continuation-in-part of U.S. patent application Ser. No. 07/336,712, filed Apr. 12, 1989.

FIELD OF THE INVENTION

The present invention relates to a method and apparatus for treating fiber suspensions in the pulp and paper industry and particularly to a method and apparatus for washing fiber suspensions.

BACKGROUND OF THE INVENTION

Known in the prior art are several different types of washing methods and apparatus therefor. Arrangements clearly differing from each other are drum washers, fourdrinier washers and diffusers. The feed consistency of drum washers and fourdrinier washers in normally between 1 and 3%. Drum washers in use at the moment are, for example, suction washers, washing presses and pressure washers. The pulp is fed into the diffuser washer at a consistency of about 10%.

A conventional suction washer comprises a wire coated cylinder which is rotatably mounted in a vat. The casing of the cylinder is provided, below the perforated plate, with a plurality of collecting compartments which are connected through a separate pipe to a valve system located on the shaft at the end of the drum. The filtrate is guided from the valve through a suction leg to the filtrate chamber. Due to the valve construction it is possible to obtain the proper suction effect at different points of the web formation.

The web formation in the suction washer is carried out in such a way that by means of a suction duct an under-pressure is generated in the cylinder rotating in the vat, which under-pressure draws pulp from the vat against the cylinder. The consistency of the fiber suspension in the vat is about 0.5 to 2%, and the consistency of the layer thickened on the cylinder surface is about 10 to 12%. The web formation area, in other words, the part of the cylinder surface which is covered by the fiber suspension in the vat, is about 140°. The maximum rotational speed of the cylinder is 2 to 2.5 r/min., since at higher rotational speed the collecting compartments and pipes for the filtrate do not have sufficient time to empty.

The washing is carried out as a displacement washing in such a way that the washing liquid is sprayed onto the surface of the cylinder which is visible outside the pulp vat. The washing liquid due to the under-pressure is drawn through the pulp layer thereby displacing most of the chemicals containing liquid therein. Consequently, the extent of the displacement area is about 120°. The typical specific square load of a vacuum washer in bleaching use is 5 BDMT/m$^2$/d, whereby the thickness of the pulp web is about 25 mm. In the bleaching use the square load of a vacuum washer is about 8 BDMT/m$^2$/d and the thickness of the web is about 30 mm.

The washer press comprises a wire coated or drilled cylinder with a perforated plate casing. The pulp is fed at a consistency of 3 to 4% and any foreign matter and impurities such as knots and the like must be removed from the pulp prior to the washer. The casing of the cylinder includes compartments from which the filtrate is guided out through a chamber in the end plate of the cylinder. The cylinder may also be open in such a way that the filtrate accumulates inside the cylinder and is discharged through an opening at the end of the cylinder. The length of the web formation zone is about 90° and that of the displacement zone 150°. The rotational speed is about 2 r/min. and the specific square load is 15 to 20 BDMT/m$^2$/d. The consistency of the washed pulp may rise even to 30% when a press roll is used. The displacement, however, is carried out when the pulp web is about 50 mm thick and has a consistency of 10%.

An apparatus in accordance with U.S. Ser. No. 921,786, now U.S. Pat. No. 4,769,986, discloses a pressure washer which comprises mainly a drilled and perforated plate cylinder on the surface of which 50 to 60 mm high stripes are mounted at intervals of about 200 mm. Filtrate compartments are disposed beneath the pulp compartments within the casing of the cylinder. A valve system is mounted to the outer rim at the end of the cylinder, through which system the filtrate is guided out. The washer may have 3 to 5 stages, in other words the filtrate is guided upstream by pumping from one stage to another. The washing liquid spaces between the respective stages are sealed.

The web formation is carried out in such a way that the pulp being washed is first fed into a feed box. The bottom of the feed box is formed by a perforated plate above which an endless wire cloth is mounted. The feed box is tapered towards the washing cylinder. When the pulp is in the feed box liquid is discharged therefrom through the wire cloth and the perforated plate, whereby the pulp is thickened on the wire cloth. While the wire cloth is moving towards the cylinder, liquid is continuously discharged from the suspension and also due to the pressure caused by the tapered construction of the feed box. At the end of the feed box the pulp is guided into the compartments between the stripes of the washing cylinder, thereby forming axial "pulp planks" or cakes having the length of the cylinder. Immediately subsequent to the feed point the cylinder is provided with the first washing zone. The washer disclosed in said publication has five separate zones. A washing liquid flow is guided to each zone and pressed through the pulp layer in the compartments of the washing cylinder thus displacing the chemicals containing liquid previously present therein. As mentioned above, the filtrates are guided upstream from one zone to another. In other words, clean washing liquid is pumped into the last washing zone and the displaced filtrate is guided into the second last zone to operate as washing liquid. Subsequent to the last washing zone, the "pulp planks" are removed from the cylinder, for example, by blowing compressed-air, and are transferred further by a conveyor screw.

The specific square load of this type of pressure washer with four stages is about 2.4 BDMT/m$^2$/d. The thickness of a "pulp plank" is about 55 mm, and the consistency may rise even up to 15–17%. The washing water running from the compartment, however, decreases the consistency to 10–12%. The consistency of the pulp being fed to the washing cylinder is 3 to 6%. The rotational speed of the cylinder being used is about 0.3 rpm.

Typically in all apparatus described above, the consistency of the pulp being fed to the washer is relatively low, i.e. 6% at the maximum. Consequently, the pulp has to be diluted prior to the washing process from the consistency of 10 to 15% of the preceding treatment zones to less than half. Thus the amount of liquid included in the pulp at least doubles. If it were possible to carry out the washing at a high consistency, savings will be gained both in size of the apparatus and in the consumption of energy, as well as in the amount of filtrate guided to the evaporation apparatus. The problem is, however, that there does not exist an apparatus, by which pulp having a high consistency, i.e. over 6%, can be fed to the washer. On the other hand, it is also known that the higher the consistency of the pulp becomes, the higher will be the air content of the suspension which, in turn, will cause foam problems in the washing process. In addition, corresponding problems are encountered with other pulp treatment apparatus, for example, with thickeners.

Some of these problems have been partially solved, for example, in an arrangement disclosed in U.S. Pat. No. 4,468,319, in which the washing of the pulp may be carried out at the consistency of 6 to 14%. The apparatus is called a stationary diffuser because it is designed to replace the continuously operating diffusers based on the use of movable filter surfaces (e.g. U.S. Pat. No. 3,372,087). The arrangement in accordance with U.S. Pat. No. 4,468,319 is characterized in that it comprises stationary annular filter surfaces mounted inside the cylindrical outer casing and respectively annular means for feeding washing liquid, arranged between them. The annular spaces generated in the above described way are divided by radial plates into sector-like parts which form the flow passages of the pulp. The pulp being treated is brought to the bottom part of the substantially conical apparatus through the rotating joint part at the top of the apparatus which part is mounted to a nozzle rotating with the shaft of the apparatus. The sectional surface area of the nozzle corresponds to the combined sectional surface area of the flow ducts formed by each separate sector. Thus, when rotating, the sector-like nozzle feed pulp into each sector formed by several axial flow ducts. Otherwise, the lower ends of the sectors are sealed by a plate seal rotating with the nozzle.

The washing liquid which is introduced into the apparatus through a hollow, rotating shaft, is guided from the feed apparatus on the opposite surfaces relative to the filter surfaces of the pulp rings, whereby the washing is carried out as a displacement washing process, i.e. the washing liquid pushes the liquid, including dissolved chemicals, towards the filter surfaces, through which it passes towards the discharge ducts. The discharge of the treated pulp is also carried out by rotating members which are mounted to the screw feeder.

Although the above described stationary diffuser has enabled the washer of pulp at a higher consistency, the above described apparatus has a number of disadvantages that have prevented a greater success of apparatus. First, the construction of the apparatus is relatively complicated due to the presence of several connections for the pressurized washing liquid and the pulp is fed and washed in a pressurized state. Additionally, the connections are rotatable and thus difficult to seal. Finally, when pulp is discharged from the apparatus, a screw feeder is still required to transfer the pulp further to the discharge vat.

SUMMARY OF THE INVENTION

The apparatus and method of the present invention substantially eliminate or minimize the described disadvantages. In the apparatus of the present invention, only the feed and discharge connections for the pulp have been maintained as pressurized connections. Additionally, the pressurized connections are constructed in such a way that leaks, should they occur, will not disturb the operation of the apparatus. Further, the apparatus in accordance with the present invention permits the discharge of pulp from the apparatus by way of its own feed pressure and directly to the discharge duct, from which, for example, a centrifugal pump may transfer the pulp for further treatment without any special screw conveyor means and/or drop legs. Thus the apparatus in accordance with this invention may be utilized to solve the feed and discharge problems of pulp in a pressurized drum washer disclosed in U.S. Ser. No. 921,786, now U.S. Pat. No. 4,769,986, mentioned above, which is herein incorporated by reference.

The method in accordance with the present invention is characterized in that the fiber suspension is fed directly from the conduit to the treatment ducts mounted between the end plates of the rotational parts of the washer, thus substantially forming extensions of the conduit. The fiber suspension is treated in the ducts and, thereafter, the treated fiber suspension is discharged from the ducts by feeding yet untreated suspension thereto.

The conduit may be a standard part of the piping of the plant, therefore minimizing the customization necessary in order to install the apparatus of the present invention.

The apparatus in accordance with the present invention is characterized in that a feed conduit for the pulp being fed to the treatment ducts of the apparatus has been mounted to one end of the apparatus and a discharge conduit for the treated pulp has been mounted to the opposite end thereof, at a substantially corresponding position with regard to the operation of the apparatus.

BRIEF DESCRIPTION OF THE DRAWINGS

The method and apparatus in accordance with the present invention are described below, by way of example, with reference to the accompanying drawings, in which.

DESCRIPTION OF THE PRESENTLY PREFERRED EMBODIMENTS

Figure 1:
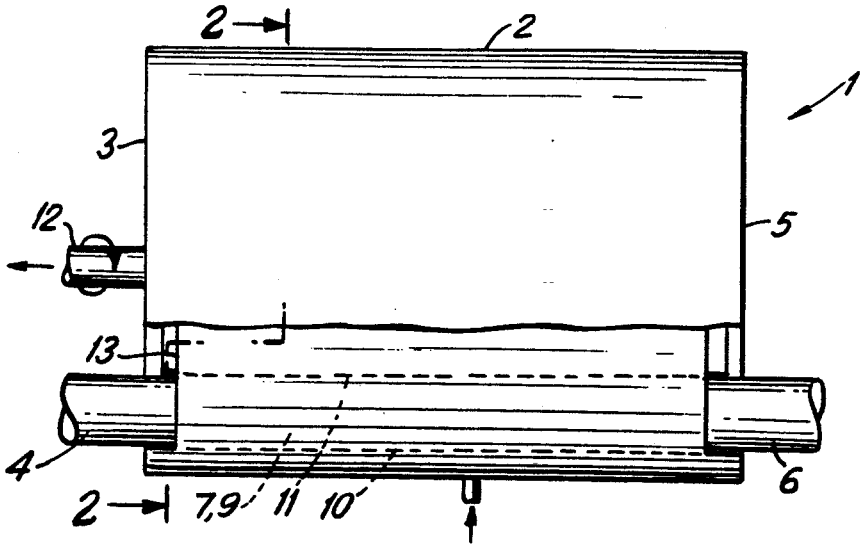
FIG. 1 is a schematic side view of an embodiment of an apparatus in accordance with the present invention.
Figure 2:
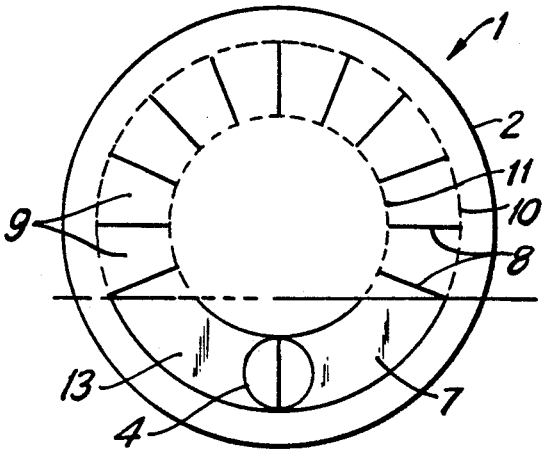
FIG. 2 is a schematic sectional illustration of an embodiment in accordance with FIG. 1 along line A—A of FIG. 1.

According to FIGS. 1 and 2, apparatus 1 comprises a cylindrical or otherwise rotationally symmetric casing 2, to the end wall 3 of which or at least in close proximity thereto, at least one inlet conduit 4 for the pulp being treated is provided. A discharge conduit 6 for the treated pulp is arranged at wall 5 at the other corresponding end of the apparatus or close to it. Pulp is fed from conduit 4 to an annular duct 7 (FIG. 2), which is advantageously divided by radial partition walls 8 into axial flow passages or treatment ducts 9. Circumferential walls 10 and 11 of annular duct 7 are preferably parallel to the rim of the casing and are formed of screens or filter surfaces to permit the entry of washing liquid but prevent the fiber suspension from passing therethrough. According to FIG. 1, the filter surface or screen wall 10, i.e. the outer filter cylinder surface, is mounted at end walls 3 and 5 of the apparatus 1 and is stationary therewith. Ducts 9 formed by screen surfaces 10 and 11 and the partition walls 8 are arranged to rotate with a shaft 12 of the apparatus advantageously in such a way that when one flow passage 9 is filled with pulp, thereby pushing the previously treated pulp column out of the duct, or at least to some extent further into the duct, the next passage or duct 9 has already turned toward the feed conduit and is in communication therewith. Advantageously, feed conduit 4 is mounted to an annular plate 13 inside the apparatus 1. Plate 13 also serves to seal the respective ends of treatment ducts 9. FIG. 2 illustrates the location of feed conduit 4 to annular plate 13. Preferably feed conduit 4 may feed pulp to not more than two adjoining parallel ducts at the same time. A corresponding type of annular plate may be used to seal the discharge conduit 6 and flow passages 9 at the opposite end of the casing 2.

The operation of the apparatus is as follows: pulp is fed from conduit 4 into substantially axial flow passages 9 formed by a continuously rotating space defined by two annular filter surfaces 10 and 11 of an inner cylinder, which is divided by partition walls 8. The washing liquid is introduced into the washer at the location indicated with an arrow in FIGS. 1, 3*a* and 3*b* and guided to one side of the flow passages while the other side is connected to the discharge system for the filtrate. Advantageously, the washing liquid is fed to a space between the outer casing 2 and the stationary outer filter cylinder 10 in a pressurized state so that it prevents the leakage of fiber suspension from the feed conduit as the liquid flows through the pulp layer in the flow passage, and is allowed sufficient time during one rotation of the cylinder to displace the chemicals containing solution in the pulp layer within the flow passage. In the case the filtrate is removed through shaft 12, pressure seal is required to seal the shaft relative to casing 2.

As shown in FIG. 1, the outer casing 2 of the apparatus 1 has a length of about 3.6 meters, the diameter of the outer filter surface is about 3.5 meters, and one of the inner filter surfaces is about 2.9 meters. The number of treatment ducts is about 35 and the dimensions of each duct is about 320×320 mm. The capacity of the apparatus is calculated to be from about 400 to about 500 tons/m of drum length i.e. about 1400 tons considering the length of about 3 meters.

Figure 3A:
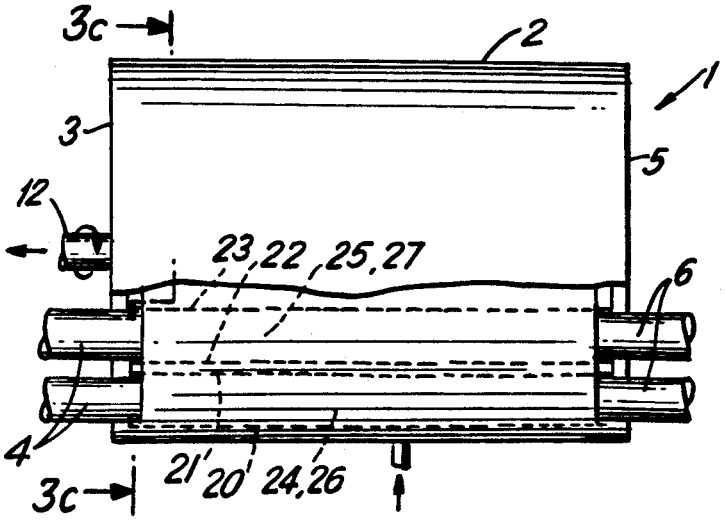
FIG. 3*a* is a partly sectional side view of another embodiment in accordance with the present invention.

FIG. 3*a* schematically illustrates an embodiment, in which two substantially coaxial annular ducts 24 and 25, each defined by two filters surfaces 20, 21 and 22, 23, respectively, are provided within the rotatable inner cylinder. The ducts are further divided by radial partition walls into smaller elongated flow ducts 26 and 27 extending substantially along the entire axis of the cylinder. In this embodiment, a greater washing volume is being utilized, but the construction of the apparatus will be correspondingly more complicated, because either the feed for the washing liquid must be constructed to operatively communicate with a rotatable inner cylinder, or the entire inner space of the outer casing must be pressurized with washing liquid, and the discharge of the filtrate must be arranged from the rotatable inner cylinder. The following represent two alternative examples of how this may be achieved. First, the treatment liquid may be introduced under pressure into a space between filter surfaces 21 and 22, from which space the liquid, due to the pressure, moves in both directions through the pulp layers present in treatment ducts 26 and 27, whereby the discharge of the filter is carried out from the space outside filter surface 20 and the space inside filter surface 23, for example, directly to the end of the apparatus or through a conduit arranged on the casing.

Figure 4:
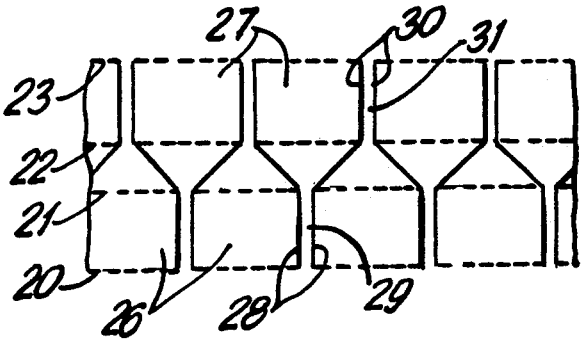
FIG. 4 is a horizontal sectional illustration of a detail of an apparatus in accordance with FIG. 3.

FIG. 4 illustrates as a second alternative an arrangement in which the washing liquid is fed to the outside of the outermost filter surface 20, from which it is divided to run partly through filter surface 20 into treatment ducts 26 and partly along flow passages 29 between partition walls 28 of ducts 26 to the space between filter surfaces 21 and 22, from which it flows further through filter surfaces 22 into treatment or flow ducts 27. Clean washing liquid is thus utilized to treat the pulp columns in both treatment ducts. The filtrate from treatment ducts 26 is discharged to the space between filter surfaces 21 and 22, from which space it flows along flow passages 31 between partition walls 30 of ducts 27 inside the filter surface 23. The filtrate from the pulp located in treatment ducts 27 also flows to the same space from which the combined filtrate may then be removed, for example, through apertures such as drill holes in the shaft (not shown). Thus the only moving parts of the apparatus requiring sealing means are the respective ends of feed conduits 4 for the pulp, which are located according to FIG. 3*a* inside the outer casing of the apparatus and are advantageously in communication with the feed space of the washing liquid in such a way that the higher pressure of the washing liquid prevents the discharge or leakage of the pulp from the feed conduits or generally from the ends of the treatment ducts to other locations within the apparatus. Advantageously, the space between filter surfaces 21 and 22 is divided in the way shown in FIG. 4 into ducts of two operational types, which are characterized in that the respective open surfaces of the pulp layers in one treatment duct are substantially as large as the pulp layer surfaces in the other treatment duct. In other words, the respective filter surfaces on opposing sides of the flow ducts 26, 27 are substantially equal in size so as to minimize the mismatch in flow resistances and to have as much displacement effect of the treatment liquid as possible.

Figure 3B:
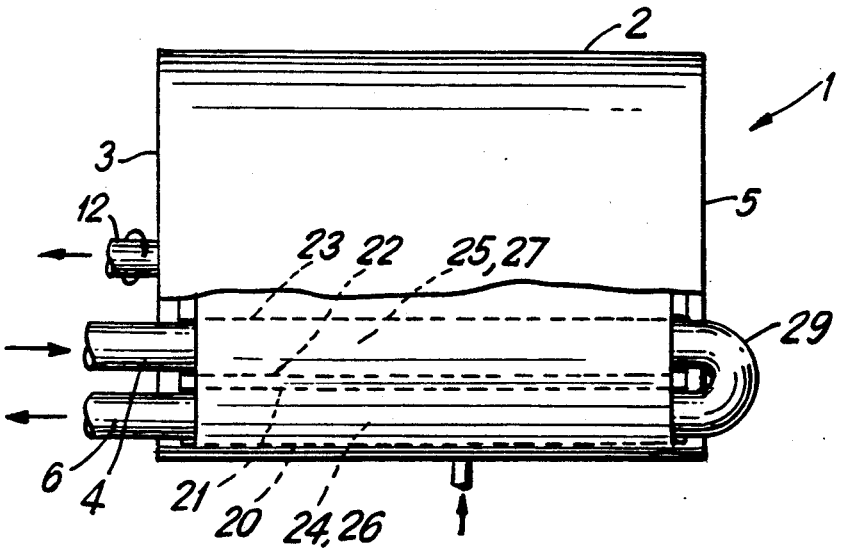
FIG. 3*b* is a partly sectional side view of yet another embodiment in accordance with the present invention.
Figure 3C:
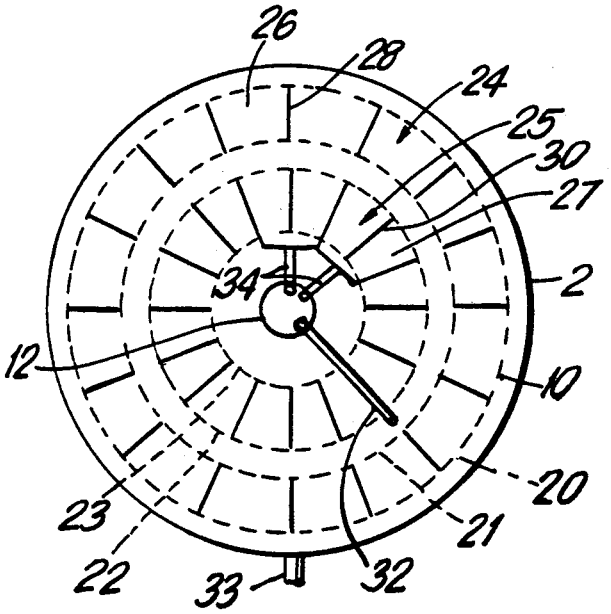
FIG. 3*c* is a sectional view along the line B—B of FIG. 3*a;*

The feed of the pulp is advantageously conducted in such a way that pulp is fed to the embodiment shown in FIGS. 3*a*, 3*b* and 3*c* into only one treatment duct at a time, in other words, only to the duct of the inner "treatment ring" or to the duct of the outer "treatment ring", whereby it is assured that substantially the same amount of pulp is fed to each duct, and that no completely stationary pulp plug is generated in either duct, so that the pulp is maintained in a constant movement.

The apparatus in accordance with the present invention can also be provided with more washing stages by arranging the treatment ducts, one inside the other, as shown in FIG. 3, and by interconnecting the ducts. In this embodiment the pulp is not discharged immediately after it has flowed once through the treatment ducts in the longitudinal direction, but it is guided, for example, through a U-shaped pipe 29 (FIG. 3*b*) inward or outward to an adjacent treatment duct, whereby the same treatment liquid will flow several times through the pulp layers resulting in a staged washing. As shown in FIG. 3*b*, pulp is first fed to the innermost treatment duct ring 25 and then guided to the next outer ring 24 at the end of the apparatus and is discharged from the apparatus after sufficiently many treatments. The treatment liquid is introduced to the outside of the outermost filter surface 20 of the apparatus, whereby it first comes into communication with the pulp that has been in the apparatus for the longest time, thus representing the cleanest pulp, and after having been filtered therethrough the washing liquid is contacted with the next "pulp ring" and so on, until the filtrate is ready to be discharged from the apparatus in an above described way. Although the U-shaped connection 29 in FIG. 3*b* is shown outside casing 2, it is understood that the connection between the inner annular treatment duct and outer annular treatment duct can be located inside casing 2. It is also understood that suitable fluidizers or the like may be added as needed to facilitate the flow of the fiber suspension from one treatment duct to the other.

As shown in FIG. 3*c*, there are provided an outer annular treatment duct 24 and inner annular treatment duct 25, respectively. As in the embodiment of FIG. 3*a*, the respective annular treatment ducts 24, 25 are divided by substantially radially extending partition walls 28 and 30 to form respective pluralities of treatment ducts 26 and 27. Washing liquid is introduced through conduit 32 between the respective annular ducts 24, 25 under pressure. The treatment liquid will then penetrate through the fiber suspension layer between filter surfaces 20 and 21 and exit from the apparatus through outlet 33. The other part of the treatment liquid will equally penetrate through the fiber layer present between filter surfaces 22, 23 and will be removed from the washer through one or more outlets 34 located within a hollow shaft 12.

Figure 7:
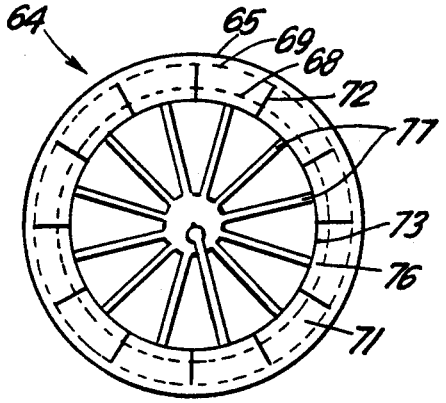
FIG. 7 is a sectional end view of the rotating drum of the apparatus in accordance with FIG. 5.

Another embodiment of the washer in accordance with the present invention is shown in FIGS. 5–8, in which the washing apparatus is covered by an outer shell 52 of any convenient shape, preferably a cylindrical shape. The end portions 53 and 54 of the outer shell or casing 52 have substantially central openings 55, 56 for receiving a shaft 57 with its bearings 58 and sealing means 59. The end portions of the outer shell are further provided with connections 60, 61 at a distance from the shaft for introducing the pulp suspension into the washing apparatus and for discharging the treated suspension from the washer. The outer shell 52, or its end portions, may comprise at least one connection 62, 63 for the sealing liquid which preferably is the same as the washing liquid. Inside the outer shell 52 there is preferably a cylindrical rotary drum 64 fastened to the shaft 57. The drum is formed by a cylindrical cover 65, which may be solid or perforated, and two end plates 66 and 67 (FIGS. 6*a*, 6*b*). Inside the cover 65 are arranged two substantially coaxial cylindrical screens which are perforated filter surfaces 68 and 69 forming therebetween a ring shaped treatment space 70. Said treatment space 70 is divided into arcuate portions 71 (FIG. 6*b*) by substantially radial wall members 72 extending from the inner perforated filter surface 68 to the respective outer perforated filter surface 69 along the substantially entire length of the drum between end plates 66 and 67, and also attaching the inner part of the drum 64 to the outer, cover part of the drum. Inside the inner perforated filter surface 68 there is a cylindrical or otherwise conveniently formed inner drum 73 for receiving the filtrate being filtered from the suspension. The end plates 66 and 67 are provided with two ring shaped openings 74 and 75 for allowing the suspension to be introduced from connection 60 into the treatment space 70 and removed therefrom through discharge connection 61. The space between the inner drum 73 and the inner perforated filter surface 68 is preferably divided into chambers 76 by the same radial wall members 72 as the treatment spaces 70. The chambers 76 are connected to the shaft 57 by conduits 77 so that the filtrate can be removed through the shaft 57 from the washer (FIG. 7).

The washing liquid is introduced into the washer via the hollow shaft 57 at the opposite end with respect to the discharge of the filtrate. The washing liquid is arranged to flow via a conduit 78 (FIGS. 5 and 6*b*) between two radial wall members 72 into the space formed between the outer cover 65 of the drum 64 and outer filter surface 69. This embodiment shows that the entire space between the cover 65 and the outer filter surface 69 is undivided in such a way that while the washing liquid is introduced at one location into said ring shaped space 70 it is able to fill the entire space and therefrom penetrate, due to pressure, first through the outer filter surface 69 and thereafter through the pulp suspension or fiber layer, thereby displacing the liquid in the pulp suspension, whereby said liquid is removed into chambers 76 and from there removed from the apparatus through conduit 77 in shaft 57.

Figure 5:
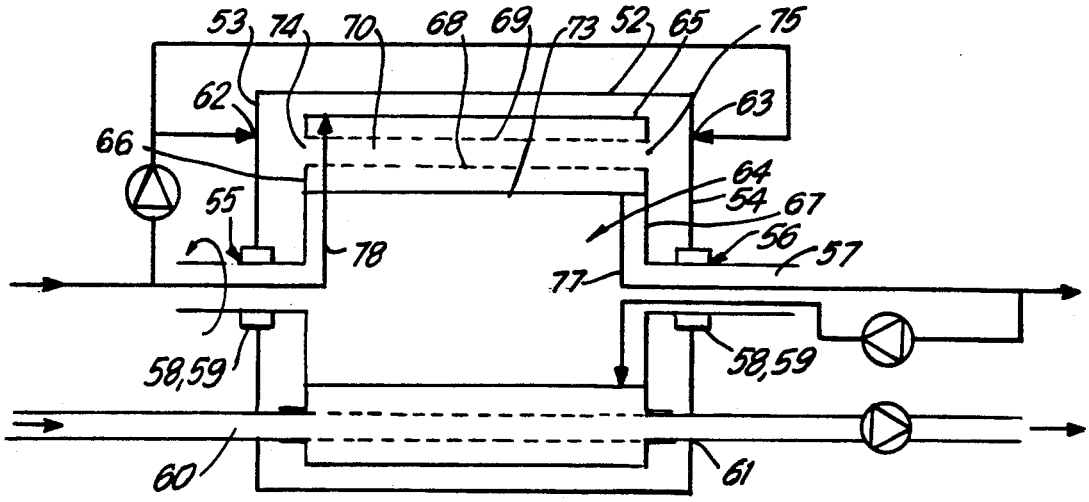
FIG. 5 is a schematic sectional illustration of another embodiment of an apparatus in accordance with the present invention.
Figure 6A:
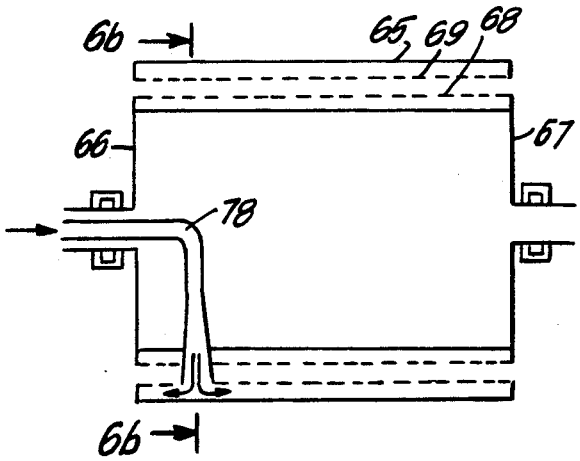
FIG. 6*a* is a sectional view of the rotating drum of the apparatus in accordance with FIG. 5.
Figure 6B:
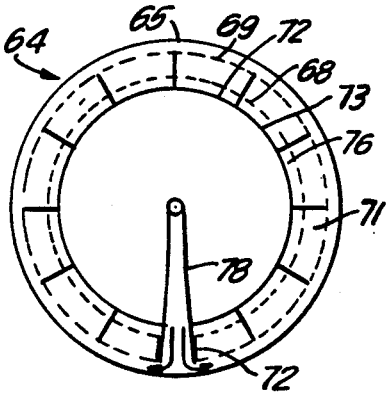
FIG. 6*b* is a sectional view along line A—A of FIG. 6*a;*

As shown in FIG. 5, connections or inlets 62, 63 are provided for liquid, preferably washing liquid, in the outer shell 52 of the washer to pressurize the outer circumferential area of the apparatus and thereby to prevent the filtrate from leaking into said space. The washing liquid may also be introduced into the washer through these connections whereby the outer cover 65 has to be perforated (not shown) so that the washing liquid may flow towards the filter surfaces. In this arrangement the structure of the washer has been simplified, but there are no means for regulating the pressure differences across outer cylindrical cover 65. If the washing liquid is introduced via the shaft and the sealing liquid separately introduced, the pressure difference between these two liquids and the respective spaces can be adjusted in such a way that the operation of the apparatus is at its optimum.

Figure 8:
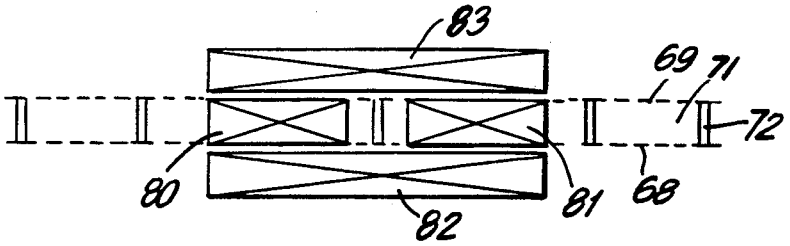
FIG. 8 is a detailed view of a sealing arrangement in accordance with the invention.

FIG. 8 shows a front view of end plates 66, 67 of the sealing arrangement provided at connections 60 and 61.

(For the sake of simplicity perforated filter surfaces 69 and 68 have been depicted as straight lines although they are in fact curved as shown in FIG. 7). Sealing members 80, 81, 82 and 83 are fastened to the end portions 53 and 54 of cylindrical cover 65 (FIG. 5) in such a way that they slidably engage the end plates 66 and 67 (sealing elements 82 and 83) or slide against the ends of the treatment ducts 71 and the ends of their radial wall members 72. The sealing members 80–83 may be formed, for instance, of Teflon and may be arranged on a metal frame structure extending close to the rotating drum. Sealing members 80 and 81 are arranged to slide inside the ring shaped opening 74 and 75, respectively. Opening 74, 75 are provided with corresponding narrow cylindrical surfaces to sealingly cooperate with said sealing members 80 and 81. In other words, the filter surfaces may extend as solid cylindrical plate surfaces axially outward from the end plates 66 and 67 in such a way that the cylindrical surfaces are able to slide along the opposite sides of sealing members 80 and 81. The cylindrical surfaces may be located either inside or outside the end plates 66, 67. Thus the sealing members 80, 81 are adapted to seal the sides of the suspension flow and sealing members 82 and 83 are made to slide on the surfaces of the end plates 66, 67 in such a way that they seal the top and bottom sides of the suspension flow. The sealing members do not have to be entirely leak proof as the end spaces of the washer apparatus are preferably pressurized in such a way that any possible leakage would occur only from the side of the sealing liquid towards the suspension. The same feature is utilized when omitting the ring shaped cover plate of the previous embodiment from the ring shaped openings 74 and 75. The sealing liquid has essentially the same pressure as the suspension inside the chambers 71. Otherwise the operation of this embodiment is similar to the operation of the previous embodiment.

Figure 9:
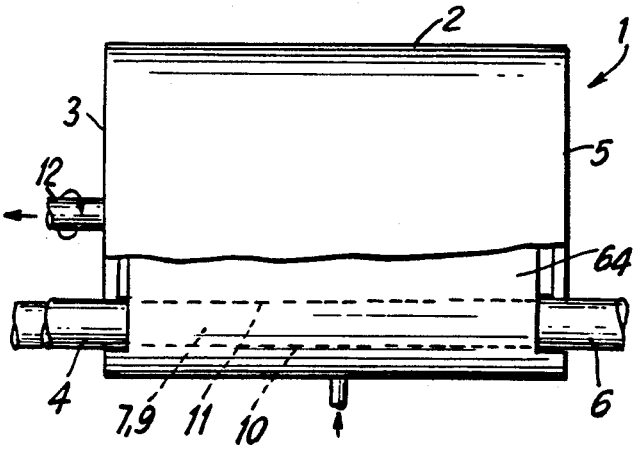
FIG. 9 is a schematic side view of yet another embodiment of the apparatus of the present invention.

As shown in FIG. 9, the diameter of the plurality of treatment ducts 7, including each individual treatment duct 9, need not be the same along the entire length thereof but may be tapered so as to be widened between the inlet conduit 4 and discharge conduit 6 to facilitate the removal of treated fiber suspension therefrom.

Figure 10:
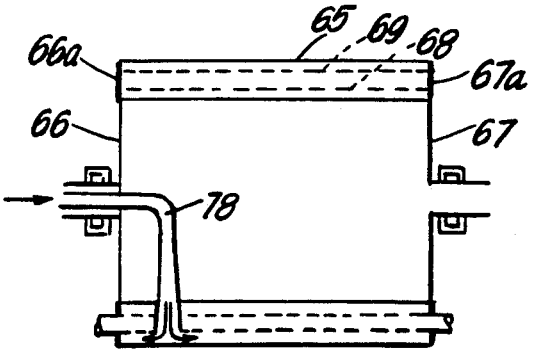
FIG. 10 is a sectional side view of yet another embodiment of the present invention.

FIG. 10 shows a further embodiment of the present invention wherein the outer casing or shell 2 forms the outer cylindrical cover 65 of the treatment apparatus. As far as possible, within the present specification, the same numerals indicate the same elements. The embodiment in FIG. 10 is similar to that described in connection with FIG. 6 in that it shows perforated filter surfaces 68, 69 within outer cylindrical casing 65 which is closed off at the front end and rear end with end plates 66 and 67, respectively. Washing liquid is introduced through conduit 78 into the space between the outer casing 65 and outer filter surface 69. The laterally open annular treatment duct or ducts may be closed by a suitable end place 66, 67 extending over the respective ducts or, if the embodiment shown in FIG. 6 is used, the annular treatment ducts may be covered by suitably fitting annular sealing member affixed at both ends of the washing apparatus. The sealing member **66*a* and 67*a*, respectively, may be formed of a solid metal plate having a suitable seal mounted on the surface which contacts the rotating drum 64**. A suitable seal may, for example, be made from a gliding Teflon plate, or the like, or may be a labyrinth seal or a combination thereof. It is also possible to adjust the duration of the washing stage in the apparatus in accordance with the present invention, for example, by varying the feed speed of the pulp being fed to the washing or treatment duct relative to the circulation speed of the ducts, so that the pulp may remain in the duct, for example, for a time equal to three rotations of the cylinder. Thereby, the newly incoming pulp will proceed only one third of the length of the washing duct and thus will also displace only one third of the pulp in the duct. The length of the washing stage of the pulp becomes thus 180° measured as rotational degrees of the cylinder.

When pulp is fed to the treatment duct and discharged due to the feed pressure of newly fed fiber suspension, it is important that the pulp does not stick too tightly to the filter surface walls of the treatment duct. During the washing stage the pulp, at least to some extent, will stick to the perforated plate, through which the filtrate is guided away. By closing the discharge outlet for the filtrate, the removal of the pulp from the filter surface is facilitated. Sometimes back wash may be used to assist in loosening the pulp from the filter surface. The stationary outer filter surface in the embodiment according to FIG. 1 has the advantage that the fibers stuck onto the filter surface are wiped off by the sweeping movement of the partition walls 8 separating the ducts 7 from each other.

Figure 11:
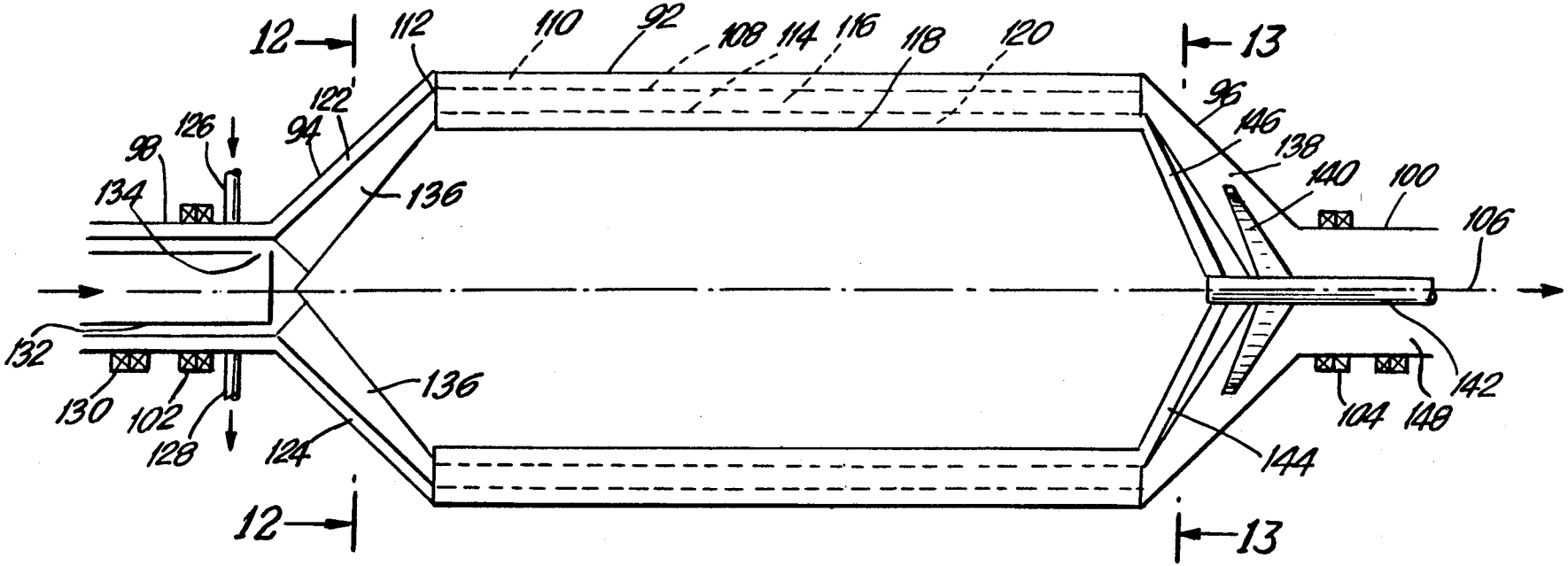
FIG. 11 is a sectional side view of yet another embodiment of the present invention.
Figure 12:
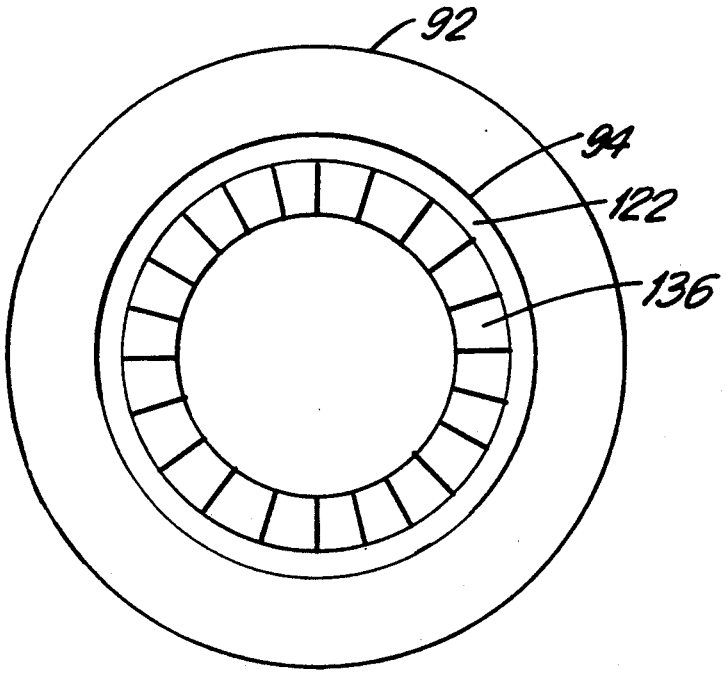
FIG. 12 is a sectional view along line B—B of FIG. 11.
Figure 13:
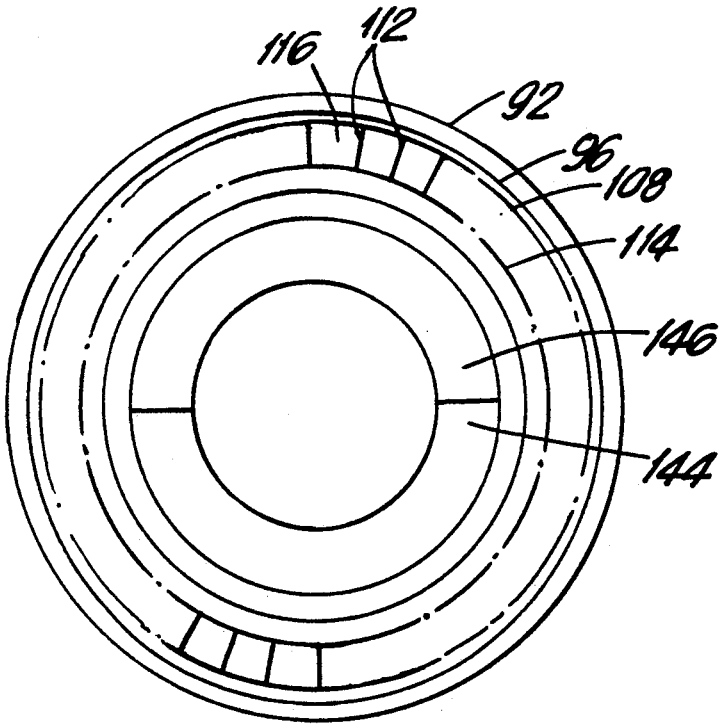
FIG. 13 is a sectional view along line C—C of FIG. 12.

FIGS. 11, 12 and 13 show yet another embodiment of the present invention. The apparatus illustrated is a so-called axial feed washer, or filter. The apparatus 90 is formed of a cylindrical, or possibly slightly conical, outer housing 92, which is, by means of conical end members 94 and 96, connected with two cylindrical sleeves 98 and 100, which are arranged to lie on bearing blocks 102 and 104, respectively. These bearing blocks 102 and 140 carry the entire weight of the apparatus and allow the apparatus to be rotated around a centrally located axis 106. Inside the outer housing 92 there is arranged an outer perforated cylindrical mantle 108 defining a first liquid compartment 110 therebetween. The mantle 108 is provided with wall members 112 projecting towards the axis 106 of the apparatus. An inner perforated mantle 114 is fastened to the inner edges of the wall members 112 such that a number of treatment ducts 116 are formed between the wall members and the opposite perforated mantles 108, 114. Inside the mantle 114 there is attached an inner cylindrical or possibly slightly conical housing 118 which is arranged to rotate together with the mantles 108, 114 and the outer housing 92 leaving a liquid compartment 120 between the housing and the inner mantle 114. The end member 94 is provided with flow channels 122 and 124 for leading either backwash liquid to the compartment 110 or for removing filtrate therefrom. The backwash liquid is introduced into the apparatus by means of a conduit 126 and the filtrate is discharged by means of a conduit 128, which have been arranged in communication with the cylindrical sleeve 98 by means of gliding sealings 130. Inside the cylindrical sleeve 98 is arranged a stationary feeding member 132, i.e. a feed conduit, for feeding the pulp into the apparatus. The member 132 is provided with an opening 134, positioned toward at least one of the conically arranged feed ducts 136 arranged in the end member 94. The feed ducts 136 communicate directly with the treatment ducts 116 so that there is one or more treatment ducts in communication with each feed duct.

The opposite end member 96 is provided with a discharge duct 138 terminating in a discharge conduit 148 within the sleeve 100. Inside the duct 138 there is arranged a stationary discharge means, in the form of a number of blades extending into the conical discharge duct 138. The purpose of the blades 140 is to facilitate the entry of thick stock into the conical discharge duct 138, which normally takes the form of an annular fiber layer, so that the layer is broken up and flows evenly into the cylindrical sleeve 100.

FIG. 11 illustrates an embodiment which operates as a two stage washer, a four stage washer with four different washing liquid feed stages or as a filter in which no washing liquid is introduced into the compartment 110, but it may be used as a filtrate compartment. The sleeve 100 is provide with an axial pipe 142, which also acts as the shaft of the discharge means, for feeding washing liquid via ducts 144 and 146 in compartments 120. For feeding the washing liquid, the pipe 142 is internally divided into two flow channels, one for each of the ducts 144 and 146.

The apparatus operates such that the pulp to be washed is introduced into the feed member 134, from which the pulp is forced, due to the feed pressure, into at least one feed duct 136 at a time. As the entire apparatus rotates, the pulp flows through the feed ducts 136 and through the treatment ducts 116, sequentially and step by step. However, the pulp in the treatment ducts 116 is either washed or thickened. Pulp in the treatment ducts 116 is washed by means of feeding washing liquid from compartment 120 through mantle 114 into the pulp layer, and filtering liquid through mantle 108 into compartment 110. Pulp in the treatment ducts may also be thickened, by means of filtering liquid from the pulp through one or both of the perforated mantles 108, 114. In the case that the apparatus serves as a multistage countercurrent washer, valves may be easily arranged both in the filtrate discharge end in connection with sleeve 98 and in connection with the washing liquid feed ducts 144 and 146 and the pipe 142. In such a case, the pipe 106 has, in accordance with a preferred embodiment of the invention, to be provided with as many flow channels as the number of the washing stages. The same holds true with regard to the opposite end of the apparatus, where as many different filtrates are received as there are washing stages. Cleaner filtrate, which generally is received from the later stages in the cleaning apparatus, is fed to the relatively earlier washing stages where a greater concentration of impurities remain.

With regard to the invention explained in connection with FIGS. 11, 12 and 13, it is also possible to reverse the filtrate and washing liquid flows from that described above, and still achieve the present advantages, so that the introduction and receiving elements are reversed. It is also possible that one or more of the flow channels, liquid compartments, treatment ducts, etc., may be conical or otherwise tapering or widening from one end thereof towards the other end, instead of being cylindrical.

As described above, the method and apparatus of the present invention considerably simplify, for example, the construction of the pressurized drum washer disclosed in U.S. patent application Ser. No. 921,786, now U.S. Pat. No. 4,769,986. Accordingly, both box or a special medium consistency feed apparatus and also the vat with its screw conveyors on the discharge side of the treated pulp may be completed eliminated. In addition to the fact that the apparatus has become considerably simplified, the washing process itself has become more effective, especially in that no air is mixed in with the pulp either with the feed or with the discharge from the apparatus, because the apparatus is preferably at all times to some extent pressurized and completely filled with washing liquid and because the discharge of the washing pulp is directed directly to the pulp line.

It is, however, understood the that above description is only of the preferred embodiments, and that there are other embodiments within the scope of this invention.

Accordingly, the above description is not intended to restrict the scope of the accompanying claims. Thus it is possible that the treatment ducts are not even in cross-section along the full length thereof, but the flow of the pulp may be facilitated by widening the sectional area of the ducts to some extent towards the discharge end. It is also understood that the individual treatment ducts may be formed of substantially tubular screen walls which are affixed at their respective ends in a rotating annular end plate having an equal number of apertures therein corresponding in size substantially to the diameter of the treatment ducts.

Also, the design of the apparatus itself does not necessarily have to be cylindrical, but it may as well be, for example, conical. Furthermore, the feed of the pulp may also be carried out at least partially in the radial direction, in other words the feed conduit may also be located in the casing of the apparatus itself and not at the end of the apparatus.

It should be understood that the preferred embodiments and examples described herein are for illustrative purposes only and are not to be construed as limiting the scope of the present invention, which is properly delineated only in the appended claims.

What is claimed is:

1. An apparatus for treating a fiber suspension comprising:

a casing having a liquid inlet and a liquid outlet port;

a plurality of elongated treatment ducts disposed within said casing for rotation about an axis of rotation, said plurality of treatment ducts each having an entrance end and a discharge end and being annularly arranged around said axis and circumferentially defined by at least one liquid permeable wall;

a feed conduit disposed for registration and axial alignment with the entrance end of at least one of said treatment ducts for feeding untreated fiber suspension into said at least one registered treatment duct;

a discharge conduit disposed for registration and axial alignment with the discharge end of said at least one treatment duct for permitting the discharge of treated fiber suspension therefrom;

means for rotating said treatment ducts around said axis of rotation to another registration position so that said entrance end and said discharge end of another one of said plurality of treatment ducts, having been subject to the treatment process and containing treated fiber suspension, is axially aligned with said feed conduit and discharge conduit, the apparatus is structured so that the feeding of the untreated fiber suspension from the feed conduit into said at least one registered treatment duct displaces the treated fiber suspension discharged into said discharge conduit.

2. The apparatus in accordance with claim 1, wherein said treatment ducts are defined by a radially lower and upper filter surface and longitudinally extending partition walls.

3. The apparatus in accordance with claim 1, additionally comprising an annular plate having an inlet aperture inside said casing and engaging said entrance end of said treatment ducts for sealing thereof and wherein said discharge conduit is attached to said annular plate in registration with said aperture.

4. The apparatus in accordance with claim 1, additionally comprising an annular plate having an outlet aperture inside said casing and engaging said discharge end of said treatment ducts for sealing thereof and wherein said discharge conduit is attached to said annular plate in registration with said aperture.

5. The apparatus in accordance with claim 1, wherein said apparatus forms a part of a pulp processing plant including piping for a fiber suspension and said feed conduit being a part of said piping.

6. The apparatus in accordance with claim 1, wherein said apparatus forms a part of a pulp processing plant including piping for a fiber suspension and said discharge conduit being a part of said piping.

7. The apparatus in accordance with claim 1, wherein the treatment includes washing filtrate from the fiber suspension and said liquid outlet comprises a shaft forming said axis of rotation and having an axial aperture therein for permitting the discharge of the filtrate from said apparatus.

8. The apparatus in accordance with claim 1, wherein said feed conduit is disposed for simultaneous registration with the entrance ends of two of said treatment ducts.

9. The apparatus in accordance with claim 1, wherein said treatment ducts have a radially extending cross-sectional surface which is tapered so as to widen from said entrance end toward said discharge end thereof.

10. The apparatus in accordance with claim 1, wherein said feed conduit is disposed for registration with the entrance end of a single one of said treatment ducts at a time.

11. The apparatus in accordance with claim 1, additionally comprising a second plurality of treatment ducts mounted within said casing substantially parallel to and for rotation about said axis of rotation; said second plurality of treatment ducts being angularly arranged around said axis and defined by a liquid permeable wall.

12. The apparatus in accordance with claim 1, additionally comprising a second plurality of treatment ducts mounted within said casing substantially parallel to and for rotation about said axis of rotation; said second plurality of treatment ducts being annularly arranged around said axis and defined by a radially lower and upper filter surface and axially extending partition walls.

13. The apparatus in accordance with claim 12, additionally comprising intermittently positioned flow ducts within said respective treatment ducts; said flow ducts being defined by said partition walls and extending substantially radially through said treatment ducts for permitting passage of liquid therethrough.

14. The apparatus in accordance with claim 12, additionally comprising connecting means for connecting said annularly disposed treatment ducts so as to permit sequential treatment of the fiber suspension within said respective ducts.

15. The apparatus in accordance with claim 1, wherein said treatment ducts are open ended; and additionally comprising means for pressurizing said casing for preventing the fiber suspension from leaking out of said ducts.

16. The apparatus in accordance with claim 15, wherein said means for pressurizing the outer casing comprises a source of pressurized washing liquid.

17. The apparatus in accordance with claim 1, wherein each treatment duct is defined by an axially extending tubular screen wall.

18. An apparatus for treating a fiber suspension comprising:

a casing having a liquid inlet and a liquid outlet port;

a plurality of elongated treatment ducts disposed within said casing for rotation about an axis of rotation; said plurality of treatment ducts each having an entrance end and a discharge end and being annularly arranged around said axis and circumferentially defined by at least one liquid permeable wall;

a feed conduit for feeding untreated fiber suspension to the entrance end of the treatment ducts;

a feed duct comprising a first and second end and being interposed between said feed conduit and at least one of said treatment ducts so that said first end is connected to said feed conduit and said second end is in registration and axial alignment with said entrance end of said treatment duct for feeding untreated fiber suspension from said feed conduit to said at least one treatment duct;

a discharge conduit at the discharge end of said treatment ducts for permitting the discharge of treated fiber suspension from said treatment ducts;

a discharge duct having a first and second end and being interposed between at least one of said treatment ducts and said discharge conduit so that said first end is in registration and axial alignment with said discharge end of said at least one treatment duct and said second end is connected to said discharge conduit for permitting the discharge of treated pulp for said treatment duct, the apparatus is structured so that the feeding of the untreated fiber suspension from the feed conduit into said at least one registered treatment duct displaces the treated fiber suspension discharged into said discharge conduit.

19. The apparatus in accordance with claim 18, wherein said feed conduit is disposed coaxially with said axis of rotation.

20. The apparatus in accordance with claim 18, further comprising a stationary axial pipe disposed within said discharge conduit and at least one washing liquid feed duct in fluid communication with said axial pipe for feeding washing liquid toward said treatment ducts.

21. The apparatus in accordance with claim 20, further comprising a blade disposed on said pipe and extending into said discharge duct for facilitating the discharge of fiber suspension from said treatment ducts.

22. The apparatus in accordance with claim 20, wherein said axial pipe is divided into a plurality of flow channels.

23. The apparatus in accordance with claim 18, wherein said discharge conduit is disposed coaxially with said axis of rotation.

24. An apparatus for treating a fiber suspension comprising:

a casing having a suspension inlet and a suspension outlet and said apparatus having a liquid inlet and a liquid outlet;

a plurality of elongated liquid permeable treatment ducts disposed annularly within said casing for rotation about an axis and for sequential registration and alignment with said suspension inlet and said suspension outlet;

a feed conduit in communication with said suspension inlet for feeding untreated fiber suspension to one of said treatment ducts;

a discharge conduit in communication with said suspension outlet for discharging treated fiber suspension from said one treatment duct;

at least one of said feed conduit and discharge conduit being coaxially disposed with respect to said axis of rotation; and means connected to said at least one of said feed conduit and discharge conduit for passing fiber suspension between said one treatment duct and one of said feed conduit and discharge conduit, the apparatus is structured so that the feeding of the untreated fiber suspension from the feed conduit into said one treatment duct displaces the treated fiber suspension discharged into said discharge conduit.

* * * * *